US011437721B2

(12) United States Patent
Samardzija et al.

(10) Patent No.: US 11,437,721 B2
(45) Date of Patent: Sep. 6, 2022

(54) DUAL BAND ANTENNA PLATE AND METHOD FOR MANUFACTURING

(71) Applicant: Plume Design, Inc., Palo Alto, CA (US)

(72) Inventors: Miroslav Samardzija, Mountain View, CA (US); William McFarland, Portola Valley, CA (US); Brian Nam, San Jose, CA (US); Christina Xu, Palo Alto, CA (US); Liem Hieu Dinh Vo, San Jose, CA (US)

(73) Assignee: Plume Design, Inc., Palo Alto, CA (US)

( * ) Notice: Subject to any disclaimer, the term of this patent is extended or adjusted under 35 U.S.C. 154(b) by 0 days.

(21) Appl. No.: 17/306,992

(22) Filed: May 4, 2021

(65) Prior Publication Data

US 2021/0257733 A1 Aug. 19, 2021

Related U.S. Application Data

(63) Continuation of application No. 16/408,532, filed on May 10, 2019, now Pat. No. 11,024,963.

(51) Int. Cl.

| | |
|---|---|
| ***H01Q 5/30*** | (2015.01) |
| ***H01Q 13/10*** | (2006.01) |
| ***H01Q 7/00*** | (2006.01) |

(52) U.S. Cl.

CPC ..... *H01Q 5/30* (2015.01); *H01Q 7/00* (2013.01); *H01Q 13/10* (2013.01)

(58) Field of Classification Search

CPC ..... H01Q 5/00; H01Q 5/30; H01Q 5/364; H01Q 5/392; H01Q 7/00; H01Q 11/04; H01Q 13/10; H01Q 9/42; H01Q 9/04; H01Q 9/0421; H01Q 21/205; H01Q 1/2291

See application file for complete search history.

(56) References Cited

U.S. PATENT DOCUMENTS

| | | | | |
|---|---|---|---|---|
| 6,853,197 | B1 | 2/2005 | McFarland et al. | |
| 6,961,545 | B2 | 11/2005 | Tehrani et al. | |
| 7,245,882 | B1 | 7/2007 | McFarland | |
| 7,245,893 | B1 | 7/2007 | Husted et al. | |
| 7,251,459 | B2 | 7/2007 | McFarland et al. | |
| 9,136,937 | B1 | 9/2015 | Cheng et al. | |
| 9,160,584 | B1 | 10/2015 | Kavousian et al. | |
| 9,647,337 | B1 * | 5/2017 | Kuo | H01Q 5/364 |
| 2011/0095954 | A1 * | 4/2011 | Sim | H01Q 13/12 343/795 |
| 2013/0090057 | A1 | 4/2013 | Green et al. | |
| 2013/0293424 | A1 | 11/2013 | Zhu et al. | |
| 2014/0009344 | A1 | 1/2014 | Zhu et al. | |
| 2014/0009355 | A1 | 1/2014 | Samardzija et al. | |
| 2014/0112511 | A1 | 4/2014 | Corbin et al. | |

(Continued)

*Primary Examiner* — Thai Pham

(74) *Attorney, Agent, or Firm* — Clements Bernard Baratta; Lawrence A. Baratta, Jr.

(57) ABSTRACT

A method for manufacturing a dual-band antenna includes stamping a metallic sheet to form an antenna plate having at least one antenna element with a low frequency section and a high frequency section having a slot; and folding the at least one antenna element about a portion of a perimeter of the stamped metallic sheet forming an upper surface, a side wall and a lower surface of the at least one antenna element.

20 Claims, 12 Drawing Sheets

(56) References Cited

U.S. PATENT DOCUMENTS

| | | | | |
|---|---|---|---|---|
| 2014/0226572 | A1 | 8/2014 | Thota et al. | |
| 2014/0292587 | A1* | 10/2014 | Yarga | H01Q 1/243 343/702 |
| 2014/0340265 | A1* | 11/2014 | Vazquez | H01Q 1/243 343/702 |
| 2015/0099474 | A1 | 4/2015 | Yarga et al. | |
| 2015/0109167 | A1 | 4/2015 | Yarga et al. | |
| 2015/0195836 | A1 | 7/2015 | Malkin et al. | |
| 2015/0302976 | A1 | 10/2015 | Chang et al. | |
| 2015/0303568 | A1 | 10/2015 | Yarga et al. | |
| 2015/0311960 | A1 | 10/2015 | Samardzija et al. | |
| 2016/0056526 | A1 | 2/2016 | Li et al. | |
| 2016/0336643 | A1 | 11/2016 | Pascolini et al. | |
| 2018/0062244 | A1 | 3/2018 | Huang et al. | |
| 2019/0190115 | A1 | 6/2019 | Samardzija et al. | |

* cited by examiner

DUAL BAND ANTENNA PLATE AND METHOD FOR MANUFACTURING

CROSS-REFERENCE TO RELATED APPLICATION(S)

The present disclosure is a continuation/divisional of U.S. patent application Ser. No. 16/408,532, filed on May 10, 2019, and entitled "Dual band antenna plate and method for manufacturing," the contents of which are incorporated by reference in their entirety.

FIELD OF THE DISCLOSURE

The present disclosure generally relates to antenna systems and methods. More particularly, the present disclosure relates to a dual band antenna plate in a wireless device, and method for manufacturing the same.

BACKGROUND OF THE DISCLOSURE

Various devices utilize antennas for wireless communication, such as wireless Access Points (APs), streaming media devices, laptops, tablets, and the like (collectively "wireless devices"). Recently, the demand for antennas for mobile wireless applications has increased dramatically, and there are now a number of applications for wireless communications that require a wide range of frequency bands. Accordingly, there is a need for a single compact antenna plate having antenna radiating elements being operable in two or more frequency bands. Further, the design trend for such devices is that they be aesthetically pleasing and capable of fitting within compact form factors.

FIG. 1 is a cross-sectional diagram of a conventional dual-band antenna 1. As shown, the conventional antenna 1 has a low frequency portion 2 resonating at 2.4 GHz on the left and a high frequency portion 3 resonating at 5 GHz on the right. Both the low frequency portion 2 and the high frequency portion 3 are either planar inverted F (PIFA) monopole or inverted F antenna (IFA) structures. The PIFA/IFA elements 2, 3 are connected to the ground plane 5 via a short pin 4. The antenna cable 6 excites the elements from a lower surface 1*a*, rather than the topside or upper surface 1*b*. One of the disadvantages of such an arrangement is the need to accommodate a length LP of the short pin 4 and the cable 6 within the space between the ground plane 5 and the high and low frequency portions 2, 3. As a result, the size of the antenna 1 overall is increased.

BRIEF SUMMARY OF THE DISCLOSURE

A wireless device with an antenna plate is provided. The wireless device has an antenna plate and comprises one or more components; and at least one antenna, integrally formed with the antenna plate, having a low frequency section and a high frequency section. The high frequency section has a slot, such that the dimensions of the slot are formed in part by a parasitic arm formed within the high frequency section.

In one embodiment, the at least one antenna and the antenna plate are formed from a single metallic sheet. In another embodiment, the high frequency section has one or more resonant frequencies in the 5-6 GHz range, and the low frequency section has a resonant frequency in the 2-3 GHz range. In another embodiment, voltage across the slot provides radiation of the high frequency section when the wireless device is in operation. In another embodiment, an inductance loop is formed around at least a portion of the slot adjacent to the low frequency section. In yet another embodiment, antenna cables are routed through a recessed trench formed within an external side wall of the at least one antenna. The antenna cable may be electrically attached at one or more points of the trench, including a location adjacent to the slot at an uppermost surface of the high frequency section. The wireless device may also include one or more components including a heatsink, a fan module, and a printed circuit board. The antenna plate may be positioned around the one or more components and disposed within a housing of the wireless device. The shape of the antenna plate may be substantially one of a ring and a polygon, and may correspond to a shape of the housing the wireless device.

Methods for manufacturing a wireless device having an antenna plate are also provided. The method includes the steps of stamping a metallic sheet to form an antenna plate having at least one antenna element with a low frequency section and a high frequency section; and folding the at least one antenna element about a portion of a perimeter of the stamped metallic sheet forming an upper surface, a side wall and a lower surface of the at least one antenna element. The high frequency section has a slot, the dimensions of the slot being formed in part by a parasitic arm within the high frequency section.

An inductance loop may be formed around at least a portion of the slot adjacent to the low frequency section. In one embodiment, the upper frequency section has one or more resonant frequencies in the 5-6 GHz range and the lower frequency section has a resonant frequency in the 2-3 GHz range. A voltage across the slot provides radiation from the high frequency section when the wireless device is in operation.

The method may further comprise the step of impressing a trench in an external surface of a side wall of the at least one antenna element, such that the trench is perpendicular to a lower surface of the at least one antenna when folded. The method may also include the step of routing an antenna cable through the trench. In an embodiment, the method includes the step of electrically connecting the antenna cable to an upper surface of the high frequency section. The lower surface of an antenna element may be a continuous common ground for the antenna plate. Alternatively, the lower surface may have an additional screw hole arm adjacent to the lower surface and extending from a side wall. The shape of the antenna plate may be substantially one of a ring and a polygon. The method may also include the step of positioning one or more components within an interior perimeter of the antenna plate, within a void.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE DISCLOSURE

In various exemplary embodiments, the present disclosure relates to an antenna plate in a wireless device, and method(s) of manufacturing the same. More particularly, the present disclosure relates to compact wireless devices and methods for constructing an antenna plate and its antenna elements for use within such wireless devices.

Wireless Device

Figure 2:
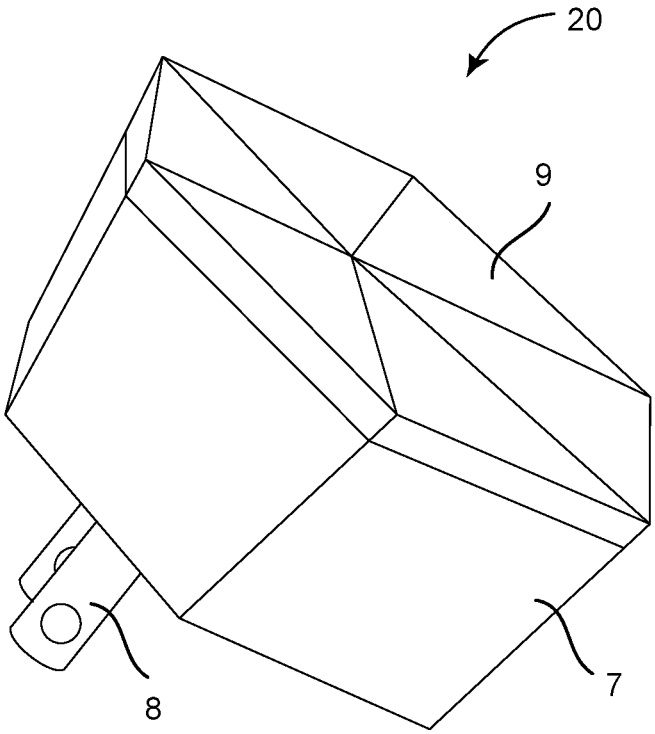
FIG. 2 is an example of a wireless device having a housing implementing the antenna plate described herein.

FIG. 2 illustrates an exemplary wireless device 20, which may include a number of components within a housing 7 (e.g., a casing, enclosure, etc.). In one embodiment, when plugged in, the top side 9 of the wireless device 20 faces out from a wall outlet (not shown), as does the antenna plate within the housing 7.

The wireless device 20 is illustrated as having an exemplary three-dimensional hexagon shape. However, in other embodiments, the housing 7 may have a number of shapes including a ring, cylinder, prism, rectangle, square, etc. Embodiments of the antenna plate described herein can be adapted and configured to fold into the shape, size and/or form factor of the housing 7. As a result, the antenna plate may take on a corresponding shape of the housing 7 or other desired shape, such as a ring, cylinder, or polygon (e.g., hexagon, prism, rectangle, square, etc.).

The wireless device 20 may have a wall plug 8 that extends out of the housing 7, for insertion into an electrical wall outlet, for example. Although not shown with specificity, the wireless device 20 may also include heatsinks, fan modules, printed circuit boards, a processor, a plurality of radios, a local interface, a data store, a network interface, power etc. It should be appreciated by those of ordinary skill in the art that FIG. 2 depicts the wireless device 20 in an oversimplified manner, and a practical embodiment may include additional components therein that are suitably configured for processing logic to support features described herein or known or conventional operating features that are not described in detail herein. A processor can be any custom made or commercially available processor, a central processing unit (CPU), an auxiliary processor among several processors, a semiconductor-based microprocessor (in the form of a microchip or chip set), or generally any device for executing software instructions. The processor may be configured to execute software stored within memory to generally control operations pursuant to software instructions. In an exemplary embodiment, a processor may include a mobile-optimized processor such as optimized for power consumption and mobile applications.

Antenna Plate and Antenna Elements

Embodiments of the antenna plates of the wireless devices of the present disclosure may have one or more antenna elements integrally formed with the antenna plate. In one embodiment, the antenna elements and antenna plate are formed from a single metallic sheet. FIGS. 7-8 and 11-12 illustrate embodiments of a completely constructed antenna plate and will be described in detail in later paragraphs.

Figure 3:
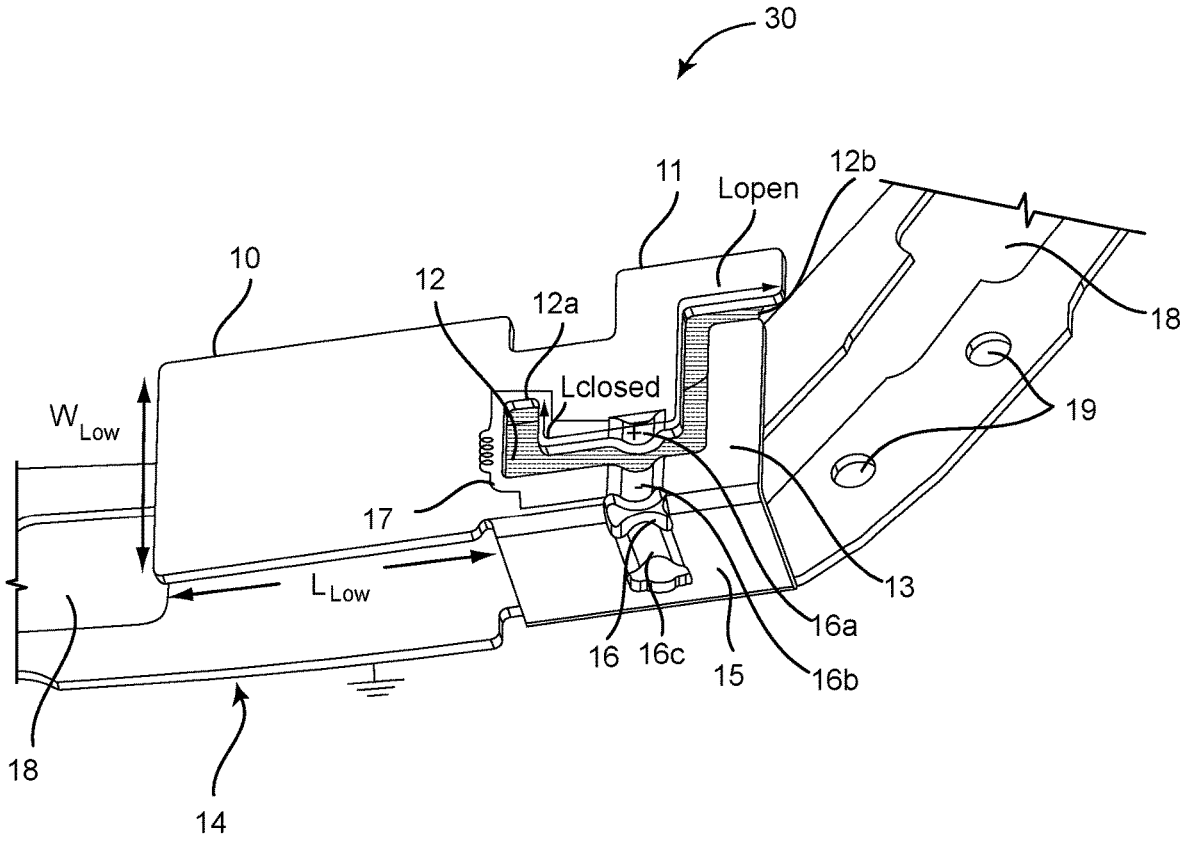
FIG. 3 is a perspective diagram of an antenna element described herein.

FIG. 3 illustrates an exemplary embodiment of an antenna element 30. The antenna element 30 is integrally formed with the antenna plate. The antenna element 30 has a low frequency section 10 and a high frequency section 11. The lower surface 14 of the antenna plate serves as ground. The lower surface 14 also has antenna cable cutouts 18 for routing of antenna cables and a plurality of screw holes 19 for receiving various metallic fasteners, such as screws or rivets, to secure the antenna plate within a wireless device.

As illustrated in FIG. 3, the low frequency section 10 has a width $W_{low}$ and a length $L_{low}$. The ratio of the $W_{low}$ to the $L_{low}$ controls the tuning of the low frequency section 10. As a width to length ratio, is increased, the low frequency section 10 tunes to a lower frequency, and vice versa. In an embodiment, the low frequency section 10 resonates at 2.4 GH, and the $L_{low}$ of the low frequency section 10 is approximately 33 mm, which is approximately ¼ of the wavelength. The dimensions of the low frequency section 10 can be designed and adjusted for a desired wavelength, in this way, length $L_{low}$ can be rescued by making the low frequency section 10 wider, in other words, by increasing $W_{low}$.

Slot Characteristics and Antenna Performance

High frequency section 11 has a slot 12. The dimensions of the slot 12 are formed in part by the parasitic arm 13 of the high frequency section 11. The parasitic arm 13 is grounded together with the low frequency section 10. The length of the slot $L_{slot}$ controls the tuning of the high frequency section 11.

Slot 12 is formed with a closed end 12*a* and an open end 12*b*. The length $L_{slot}$ of the slot 12 is the distance from the closed end 12*a* to the open end 12*b*. A typical length $L_{slot}$ is approximately ½ the wavelength and controls the tuning of the high frequency section 11. $L_{slot}$ can be separated into two parts, $L_{closed}$ and $L_{open}$, as shown in FIG. 3. A typical length $L_{open}+L_{closed}$ is approximately ¼ of the wavelength, whereas $L_{closed}$ controls the size of the inductance loop 17. As such, the longer $L_{closed}$ is, the greater the inductance, and vice versa. In an embodiment, the high frequency section 12 resonates at 5 GHz, and $L_{slot}$ is about 15 mm. Shortening or lengthening $L_{closed}$ relative to $L_{open}$ or vice versa can compensate for a desired $L_{slot}$ in order to achieve a desired frequency tuning.

Figure 4:
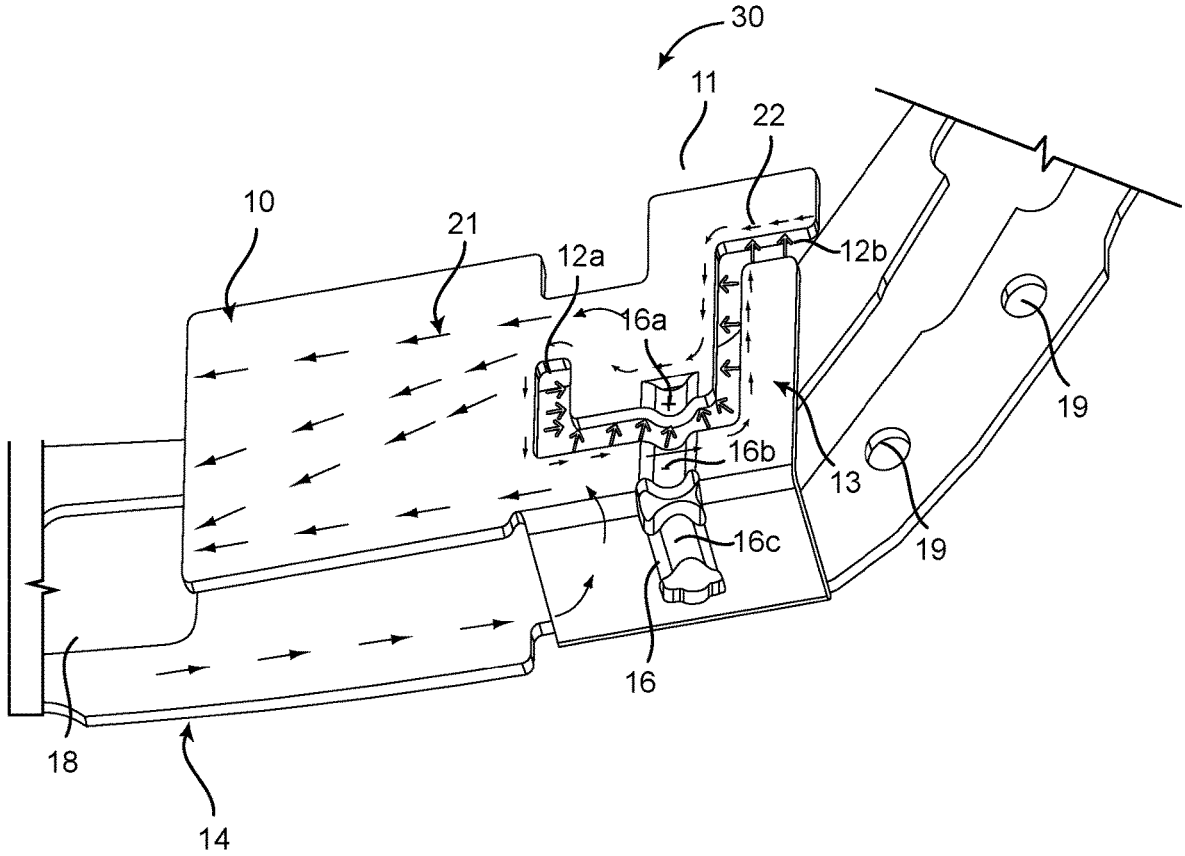
FIG. 4 is a perspective diagram illustrating the current flow of an upper and lower frequency band of the antenna element of FIG. 3.

FIG. 4 is a perspective diagram illustrating the current flow of an upper 11 and lower 10 frequency sections of the antenna element 30 of FIG. 3. A portion of the slot 12 forms an inductance loop 17 for the lower frequency section 10. This is illustrated by the inductance loop 17. (The inductance loop 17 is not a physical electrical component.) It is illustrated here to show how the slot 12 serves as an inductance element to the low frequency section 10, while also serving as a radiating element to the high frequency section 11. In one embodiment, the antenna element 30 can have resonant frequencies in both a lower 2-3 GHz frequency band and a higher 5-6 GHz frequency band ranges.

In one embodiment, the antenna element 30 has two resonance frequencies, in which a low frequency range is 2.4 GHz and a high frequency range is 5 GHz. In this embodiment, the antenna plate is suitable for use in various wireless (Wi-Fi) applications/devices.

Figure 1:
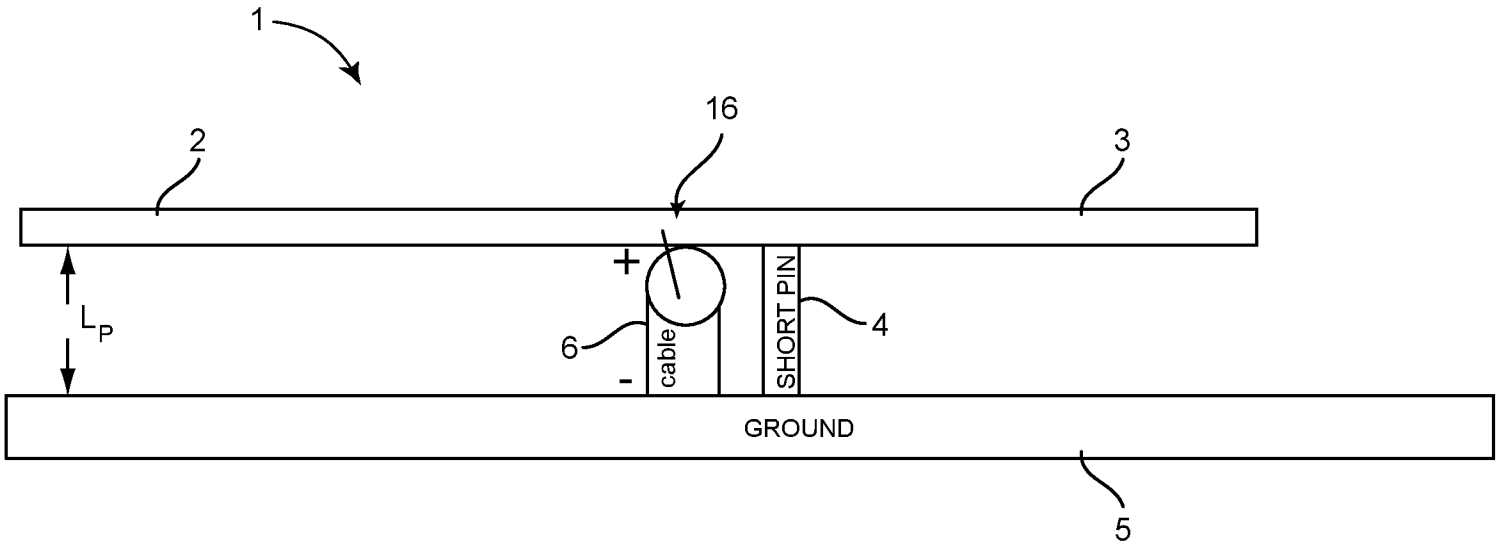
PRIOR ART FIG. 1
FIG. 1 is a cross-sectional diagram of a conventional dual-band antenna.

FIG. 4 illustrates the direction of two primary current flows on the antenna element 30. The longer arrows 21 across the low frequency section 10 and on the lower surface 14 of the antenna plate are stronger and correspond to the low frequency section 10. The shorter arrows 22 around the slot 12 correspond to the current flow of the upper frequency section 11. The longer the arrows, the stronger the. The shorter arrows 22 and across the slot 12 correspond to the electric field of the upper frequency section 11. The longer the arrows, the stronger the electric field. As illustrated, the electric field is stronger at an open end 12*b* of the slot 12 and weaker at the closed end 12*a*. The electric field created across the slot 12 is the source of the radiation of the upper frequency section 11, whereas current flow is the primary source of radiation for the low frequency section 10. One of the benefits and advantages of this configuration is that because radiation is achieved from the voltage across the slot 12, the antenna element 30 is less sensitive to any disruption from antenna cable cutouts 18 that run beneath it, as compared to conventional dual band antennas, such as the antenna 1 of FIG. 1.

Figure 5:
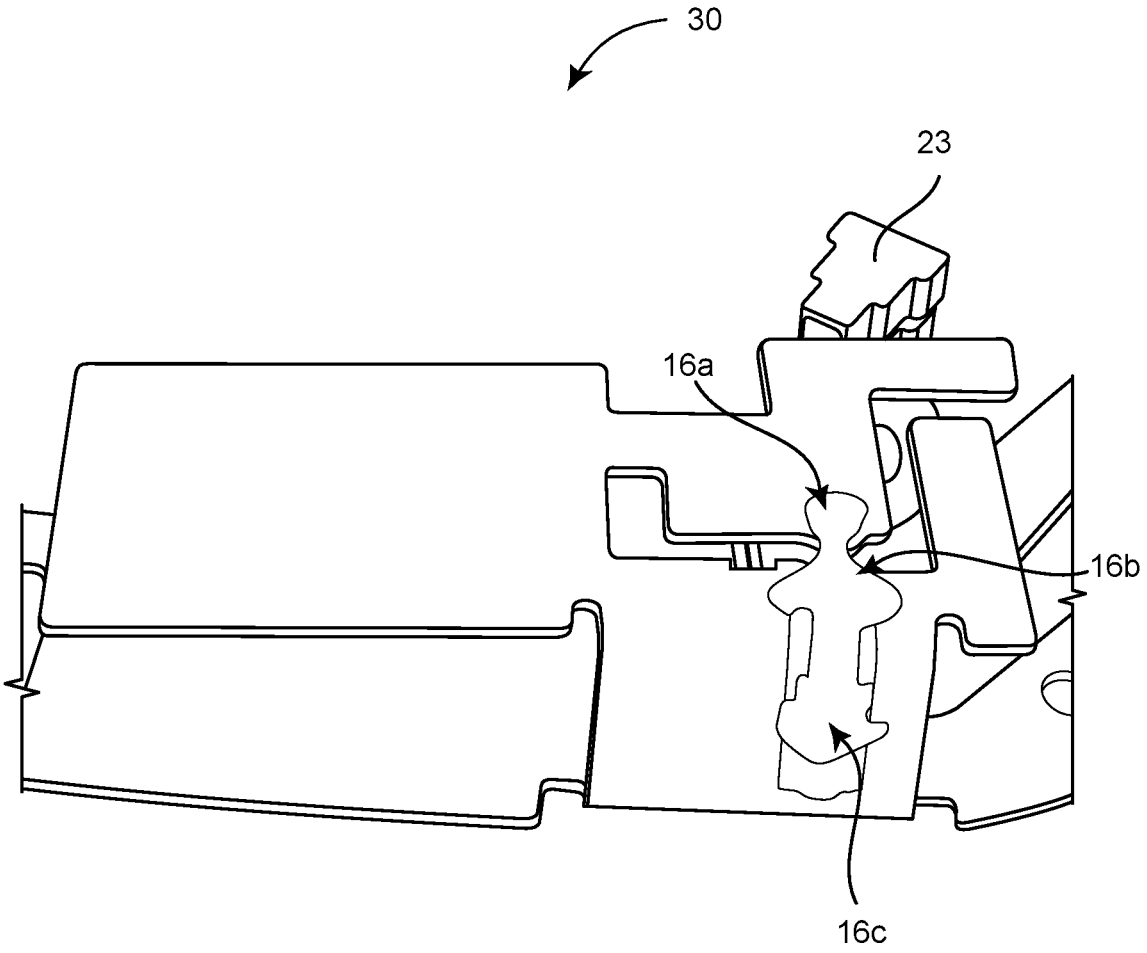
FIG. 5 is a perspective diagram of an antenna cable routed through a trench and soldered to the top of the antenna element of FIG. 3.

FIG. 5. is a perspective diagram of an antenna cable 23 routed through trench 16 (e.g., a recessed portion, groove etc.) formed in the side wall 15 of the antenna element 30, and upper surface of the high frequency section 11 of the antenna element 30. The trench 16 extends in a portion of the sidewall 15, crosses over the trench 16 and ends adjacent to the slot 12 on a top surface of the high frequency portion 11. Three electrical connection points 16*a*, 16*b* and 16*c* to the antenna element 30 are provided for an antenna cable 23. These points correspond to the + and −signs labeled in FIGS. 3 and 4, as 16*a*, 16*b* and 16*c* respectively. Connection point 16*a* is the uppermost connection point for the antenna cable 23, located at an uppermost surface of the antenna element 30. Connection point 16*a* is the location where the inner conductor of an antenna cable 23 is electrically connected or soldered. The inner and outer conductors of the antenna cable 23 are electrically connected or soldered at connection points 16*b*, 16*c* respectively, within the trench 16.

One of the benefits and advantages of the configuration of the trench 16 as provided is that it allows for an antenna cable 23 to be recessed. This reduces the overall height of the antenna element 30, and thus reduces the height of the overall antenna plate, which allows the antenna plate to fit more compactly in smaller form factors for wireless applications, such as wireless device 20.

Figure 6:
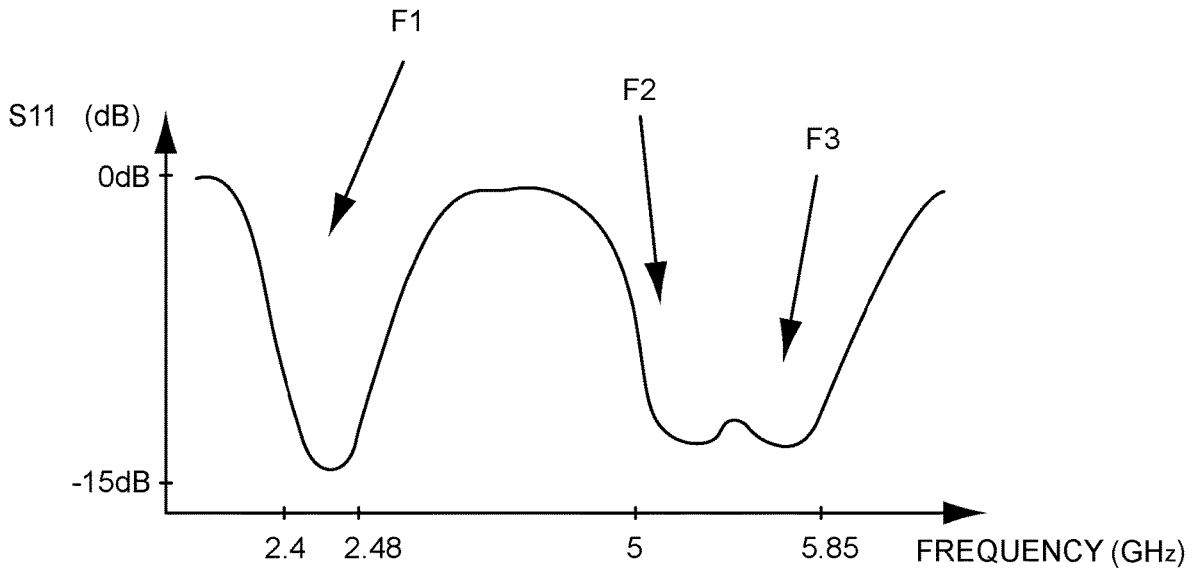
FIG. 6 is a graph of the exemplary performance of the antenna element of FIG. 3.

FIG. 6 is a graph of the exemplary performance of an embodiment of the antenna element 30. Due to the radiating resonance of the low frequency section 10, a radiating harmonic in an upper frequency band and the radiation of the slot 12 in the high frequency section 11, it is possible for the antenna element 30 to be capable of not only dual resonance, but also triple resonance. For example, as shown in the graph, the antenna may resonate at a first frequency $F_1$ between 2.4 GHz and 2.48 GHz, as well as two higher frequencies between 5 GHz and 5.85 GHz, $F_2$ and $F_3$.

Method(S) of Manufacturing the Antenna Plate

The present disclosure also provides embodiments for a method of constructing or manufacturing an antenna plate 60 and associated wireless device. First, a single metallic or conductive sheet is provided and then stamped with a pattern to create the various features of the antenna plate 60. The pattern may include components such as one or more antenna elements 30, 32, 34 having parasitic arms 13 and slots 12, screw holes 19, 25, antenna cable cutouts 18 etc. As noted above, the antenna elements 30, 32, 34 are integrally formed with the antenna plate 60.

Figure 7:
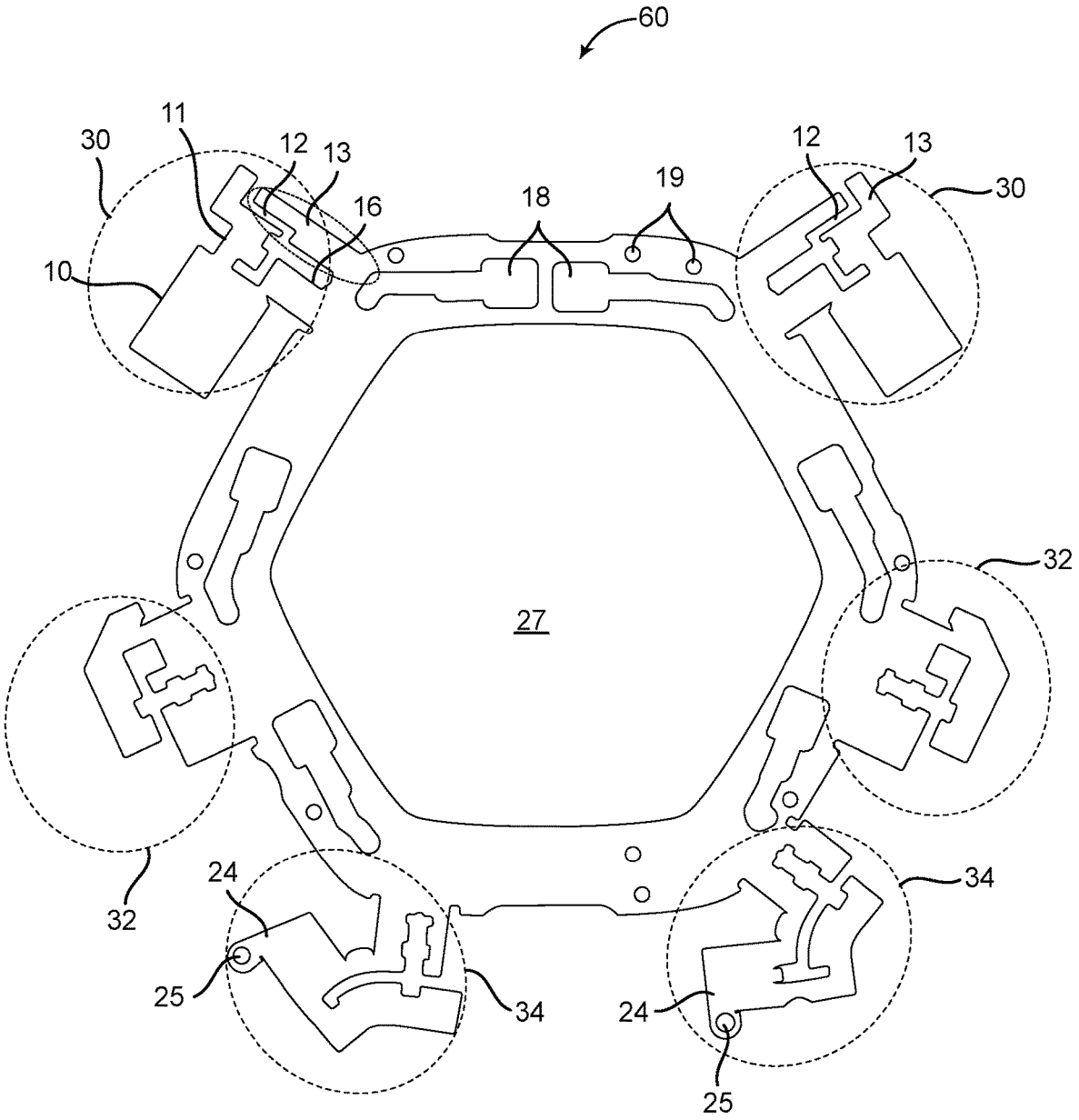
FIG. 7 is a two-dimensional plan view of an antenna plate having multiple stamped antenna elements as described herein.

FIG. 7 is a two-dimensional plan view of an antenna plate 60 having multiple stamped antenna elements 30, 32, 34 are provided. Note, while exemplary antenna element 30 has been described in detail herein, other antenna elements, such as antenna element 32, 34 having high and low frequency sections with different shapes or the same shape may be provided on a given antenna plate 60 with varying resonant frequency ranges depending on the desired application of the corresponding wireless device.

For example, antenna element 30 is illustrated in a two-dimensional form with low frequency section 10 and high frequency section 11 have a slot 12 formed in part by a parasitic arm 13, after being stamped out of a metallic sheet. The dimensions of the slot 12 are therefore formed in part by the parasitic arm 13 within the high frequency section 11. The slot 12 is adapted and configured to form an inductance portion for the low frequency section 10 of the antenna element 30. Antenna elements 32, 34 may also be similarly configured and formed with the antenna plate.

In one embodiment, the antenna elements 30, 32, 34 are stamped around a perimeter of the antenna plate 60, so that they are as far away from a center of the antenna plate 60 as possible. One benefit and advantage of stamping the pattern in this manner is to allow the central portion or void 27 within the inner perimeter of the antenna plate 60 to be empty so that other components or circuitry of the wireless device for which it is used can be provided within the void 27. These components might include, for example, a fan module, RF components or other hardware associate with the wireless device as described herein. The step of stamping also may include of impressing a trench 16 in an external surface of the side wall 15 of one or more of the antenna elements 30, 32, 34, such that when the trench 16 is folded, it is oriented substantially perpendicular to a lower surface 14 of the at least one antenna 30.

Figure 8:
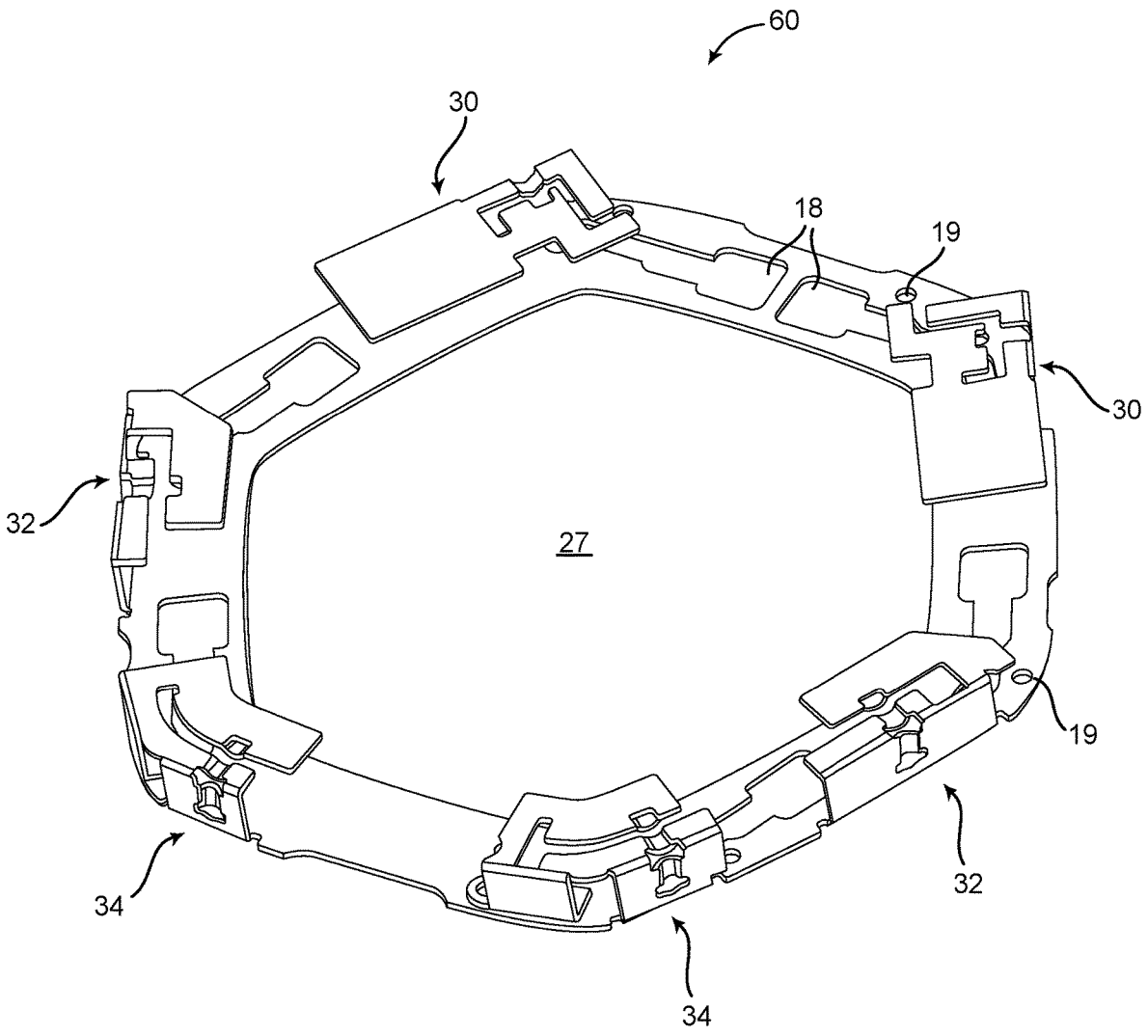
FIG. 8 is a three-dimensional perspective view of the antenna plate of FIG. 7 after the antenna elements have been folded about the outer perimeter of the antenna plate.

FIG. 8 is a three-dimensional perspective view of the antenna plate 60 of FIG. 7 after the antenna elements 30, 23, 34 have been folded about the outer perimeter of the antenna plate 60. The folding step may occur in multiple steps, such as two or three or more steps depending on the structure of any given antenna element 30, 32, 34. During this step, the antenna elements 30, 32, 34 are folded around a perimeter of the antenna plate 60, which reduces the overall dimensions of the antenna plate 60. This allows for more volume/space for other components within the wireless device. This is especially advantageous for wireless devices having small form factors. In addition, using multiple steps for the folding process has the benefit and advantage of avoiding potential cracking or degradation of the metallic sheet from which the antenna plate 60 is formed. The antenna plate 60 does not require any additional ground for all the antenna elements 30, 32, 34 to function properly.

Figure 9:
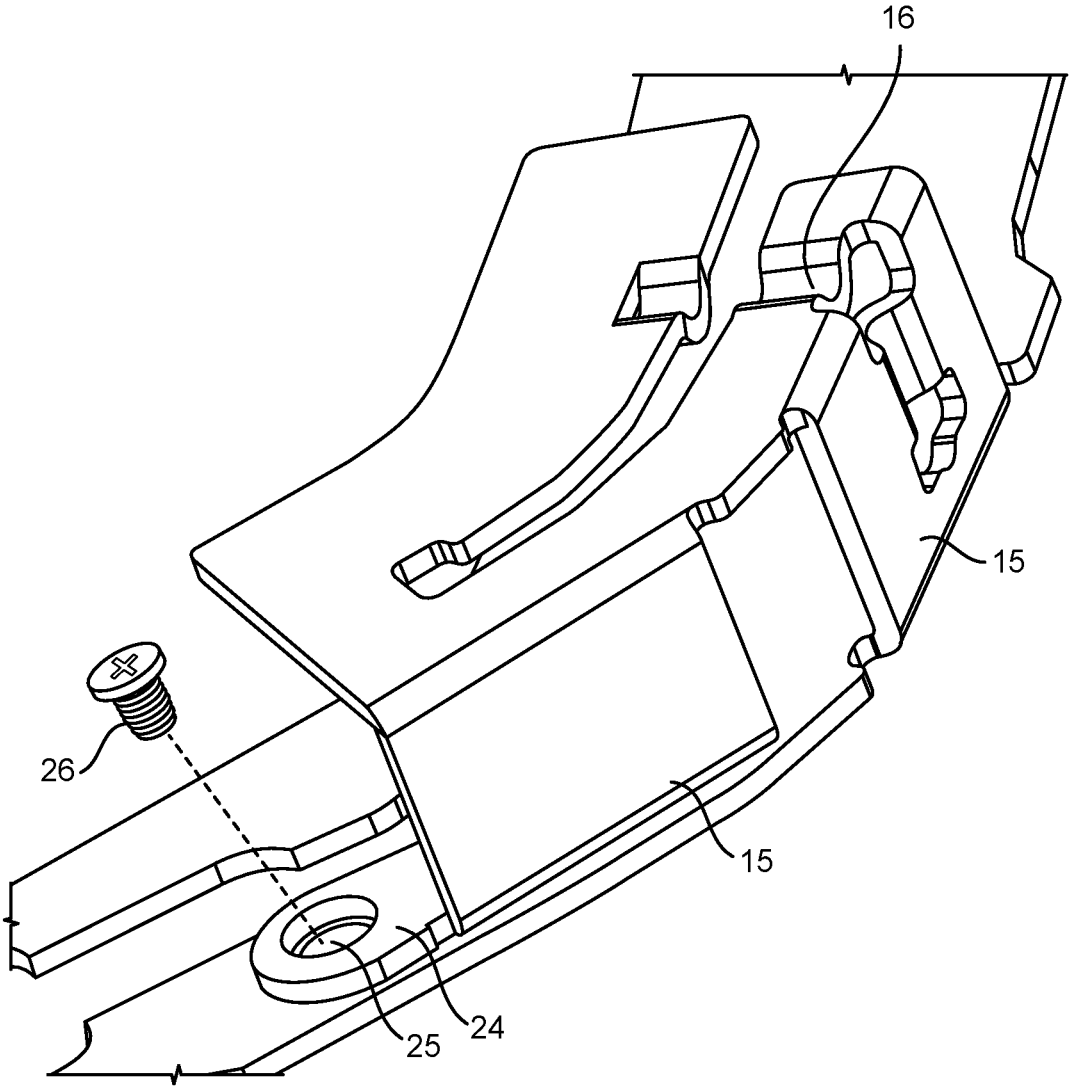
FIG. 9 is a perspective diagram of another embodiment of an antenna element, the lower frequency portion formed with a lower ground wall and screw hole.

FIG. 9 illustrates an embodiment in which an additional folding step is made to create a screw hole arm 24 having a screw hole 25 defined within it to engage a screw 26 (e.g., a fastener or ring screw). The screw hole arm 24 is attached to one of two sidewalls 15 of the antenna element 34 adapted and configured so that it rests adjacent to the lower surface 14 when folded. The screw hole arm 24 can be used as a surface for providing a location of a structural screw 26 for the antenna plate 60, as well as a ground connection to the antenna plate 60 from the wireless device. The screw hole arm 24 and screw 26 also holds antenna cable clips 28 (See FIGS. 11-12) for securing the antenna cables 23 to the antenna plate 60. The additional fold for screw hole arm 24 is made at a slightly lower point from the other elements, such that that the screw hole arm 24 stays in place due to downward pressure, and/or friction fit from the antenna plate 60 rather than solely from the pressure of the corresponding screw 26.

Figure 10:
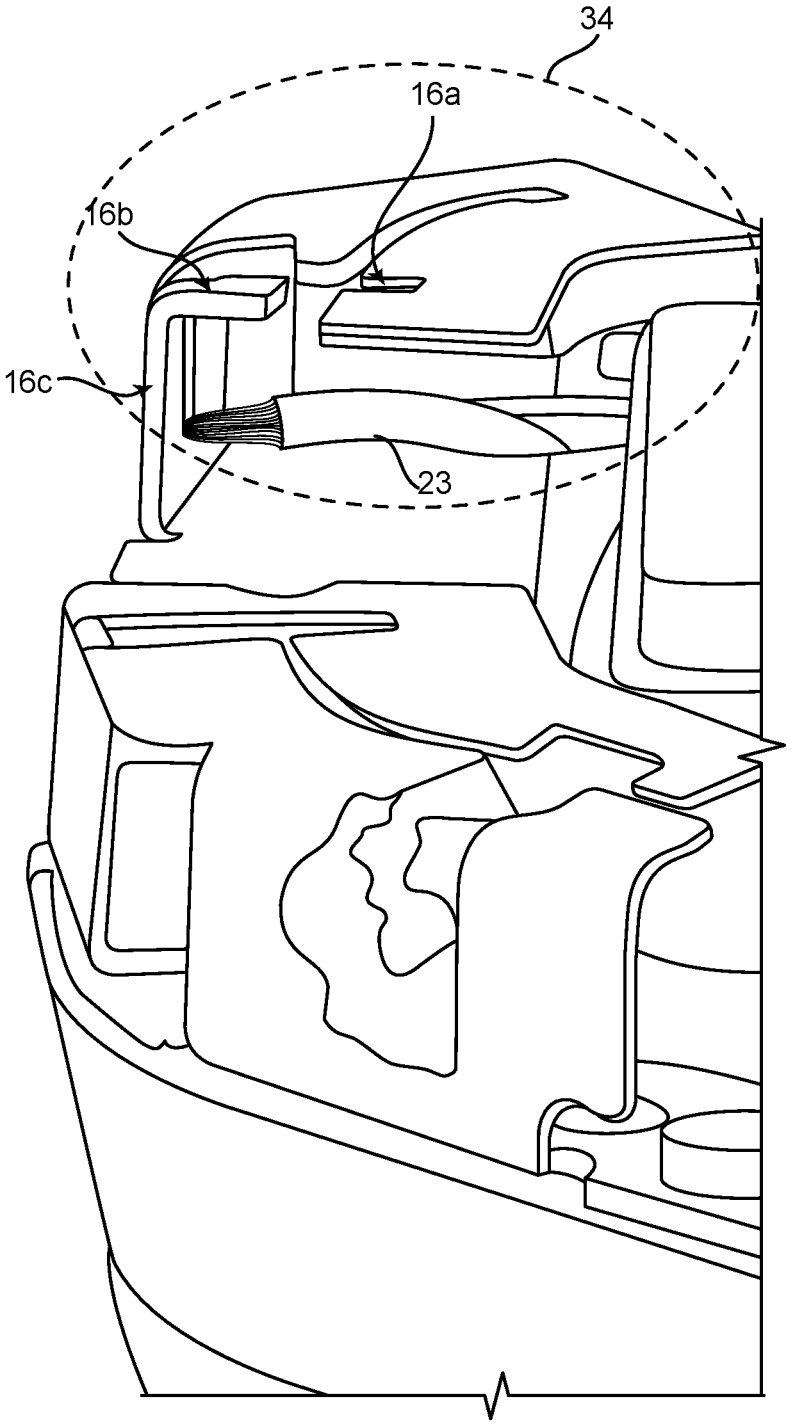
FIG. 10 is a perspective diagram of the antenna element of FIG. 9 showing a cable routed through the trench.

FIG. 10 illustrates the routing and soldering steps. After the antenna elements 30, 32, 34 have been stamped and folded, antenna cables 23 are routed through the antenna cable cutouts 18 and placed in the recessed trenches 16 formed within the side walls 15 of the antenna elements 30, 32, 34. The antenna cables 23 are routed through mouse holes or openings in the side wall 15 within the trench 16 created during the stamping step to allow the antenna cable 23 to be routed from inside of the antenna plate 60, to the outside of the antenna plate 60. The antenna cables 23 are then recessed within the trench 16 and attached at the connection points 16*b* and 16*c* and 16*a* at a top surface of the antenna element 34. This preserves the gap between the overhanging antenna element 34 and the bottom surface 14 of the antenna plate 60. In doing so, the antenna cables 23 are routed to minimize the usage of the portion of the path under the low frequency section of the antenna element 34.

In addition, other holes may also be cut out during the stamping step for additional cable routing possibilities, in the event that antenna cables 23 need to be routed from below the antenna plate 60 within the wireless device. The antenna hole cutouts 18 are purposely offset relative to the antenna elements 30, 32, 34 in order to ensure that they do not couple and reduce radiation performance.

Multiple ground connections may also be provided which serve as dual purposes as electrical ground, while also mechanically supporting the antenna plate 60. These ground connections may be provided at the outer edge of the antenna plate 60, which is also the outer edge of the wireless device, which enables better performance of the antenna elements 30, 32, 34.

Antenna Plate within a Wireless Device

Figure 11:
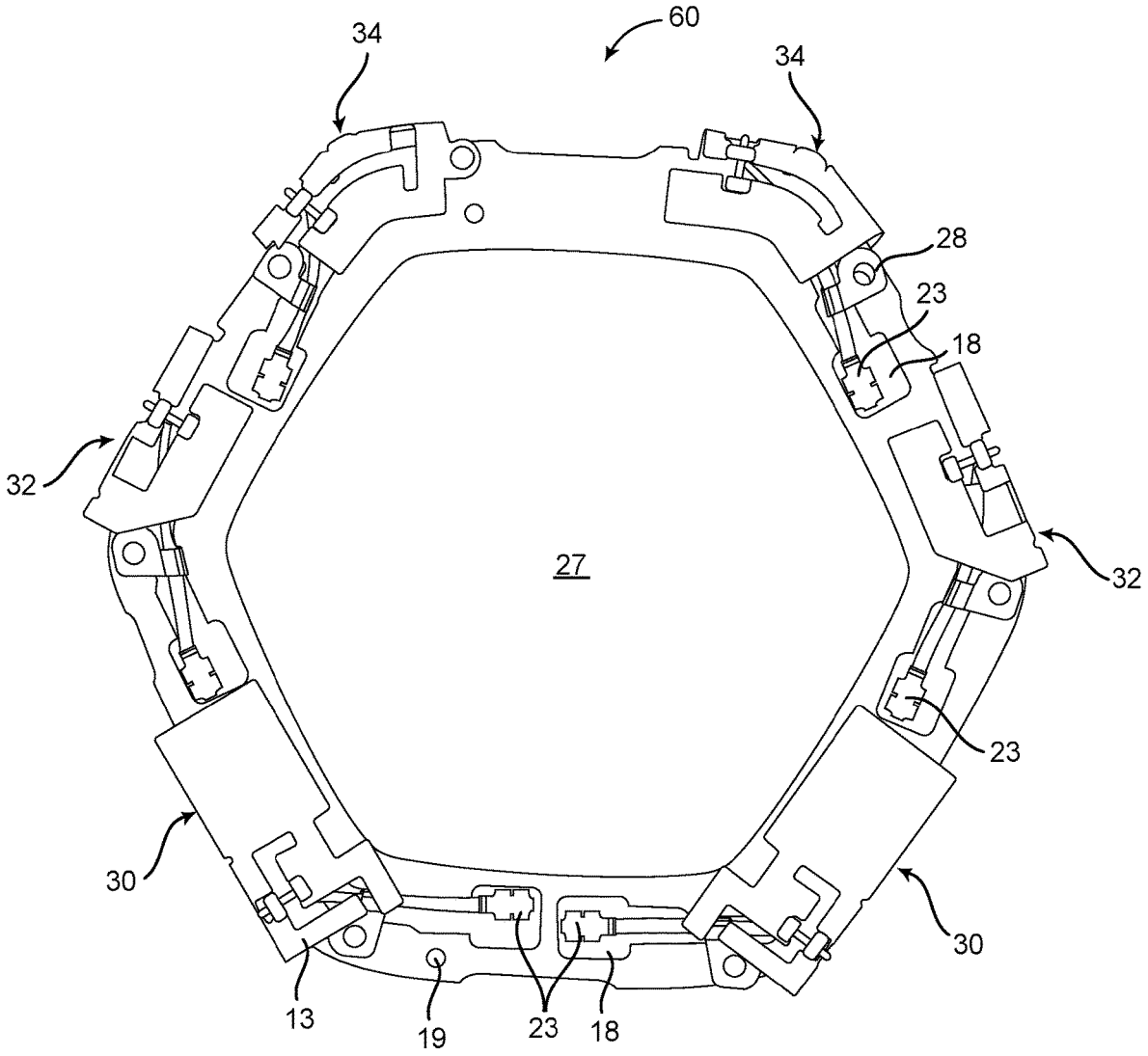
FIG. 11 is a plan view of a three-dimensional antenna plate after the antenna elements have been folded and respective antenna cables have been wired and soldered to the antenna elements.

FIG. 11 is a plan view of a three-dimensional antenna plate 60 after the antenna elements 30, 32, 34 have been folded and respective antenna cables 23 have been wired and soldered to the antenna elements 30, 32, 34. One of the benefits and advantages of the antenna plate 60 of the instant application is that the antenna plate 60 can completely assembled separately from the wireless device 20. Once the antenna plate 60 is constructed, it can be secured by screwing, connecting, clipping or otherwise mechanically securing the antenna plate 60 into the housing 7 of the wireless device 20. The antenna elements are also connected via the antenna cables 23 to the relevant portions of the wireless device 20. Antenna clips 28 may also be soldered to the ground sheaf of the antenna cable 23 to minimize resonance of the antenna cable 23.

Figure 12:
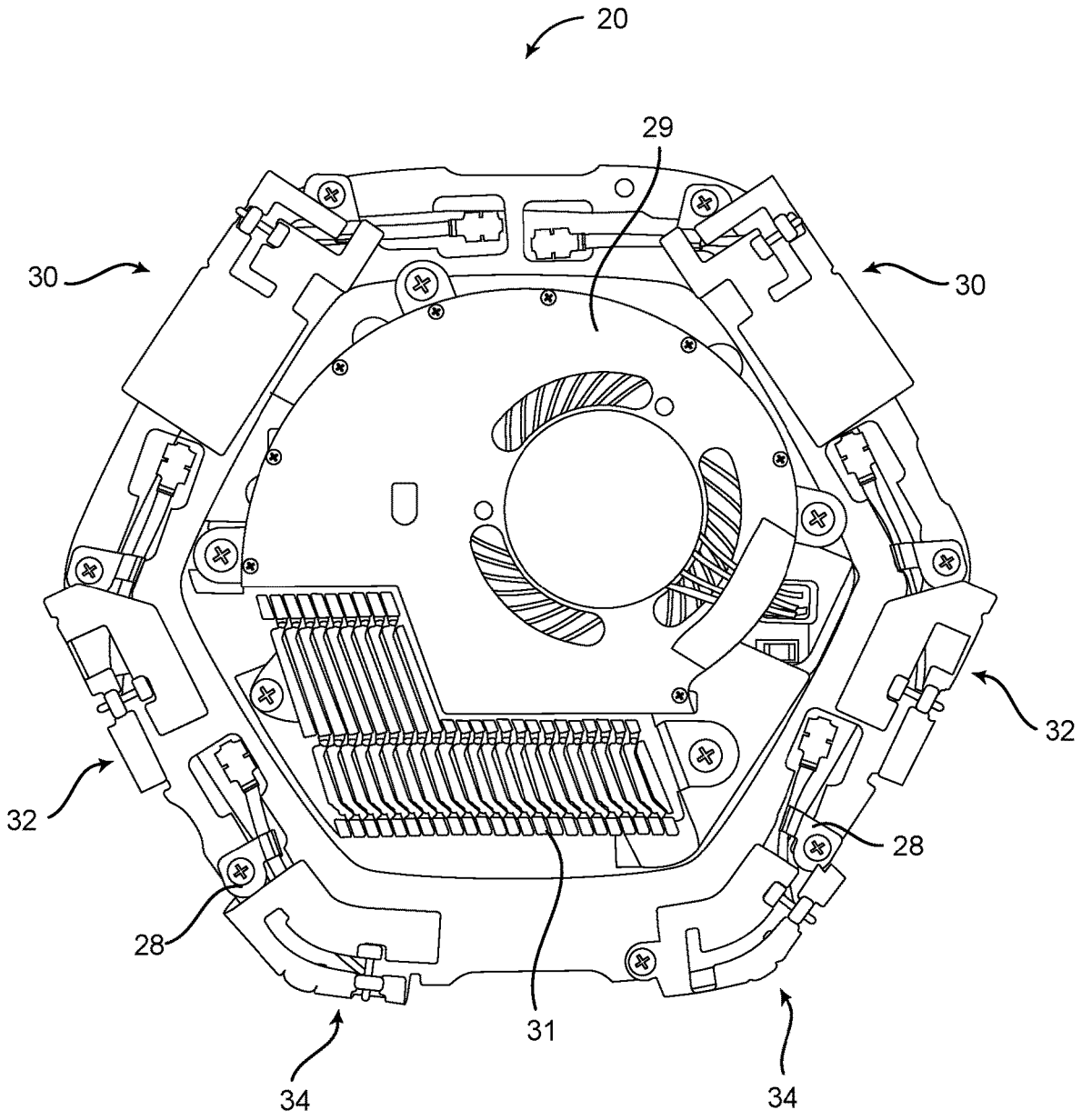
FIG. 12 is a plan view of the antenna plate of FIG. 11 attached to one or more components of the wireless device.

The overall shape of the antenna plate 60 allows room for other components to reside in the void 27 within the center of the wireless device within the inner perimeter of the antenna plate 60. FIG. 12 illustrates is a plan view of the antenna plate of FIG. 11 attached to one or more components 29 of the wireless device. In this embodiment, the antenna plate 60 is shown disposed around a fan module 31 for use within the wireless device 20. While not shown with specificity, the antenna plate 60 may be disposed around the perimeter of other components 29 such as a heat sink, printed circuit board with a processor etc.

It will be appreciated that some exemplary embodiments of the wireless device described herein may include a variety of components such as one or more generic or specialized processors ("one or more processors") such as microprocessors; Central Processing Units (CPUs); Digital Signal Processors (DSPs): customized processors such as Network Processors (NPs) or Network Processing Units (NPUs), Graphics Processing Units (GPUs), or the like; Field Programmable Gate Arrays (FPGAs); and the like along with unique stored program instructions (including both software and firmware) for control thereof to implement, in conjunction with certain non-processor circuits, some, most, or all of the functions of the methods and/or systems described herein. Alternatively, some or all functions may be implemented by a state machine that has no stored program instructions, or in one or more Application Specific Integrated Circuits (ASICs), in which each function or some combinations of certain of the functions are implemented as custom logic or circuitry. Of course, a combination of the aforementioned approaches may be used. For some of the exemplary embodiments described herein, a corresponding device in hardware and optionally with software, firmware, and a combination thereof can be referred to as "circuitry configured or adapted to," "logic configured or adapted to," etc. perform a set of operations, steps, methods, processes, algorithms, functions, techniques, etc. on digital and/or analog signals as described herein for the various exemplary embodiments.

Moreover, some exemplary embodiments may include a non-transitory computer-readable storage medium having computer readable code stored thereon for programming a computer, server, appliance, device, processor, circuit, etc. each of which may include a processor to perform functions as described and claimed herein. Examples of such computer-readable storage mediums include, but are not limited to, a hard disk, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory), Flash memory, and the like. When stored in the non-transitory computer-readable medium, software can include instructions executable by a processor or device (e.g., any type of programmable circuitry or logic) that, in response to such execution, cause a processor or the device to perform a set of operations, steps, methods, processes, algorithms, functions, techniques, etc. as described herein for the various exemplary embodiments.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. A method for manufacturing a dual-band antenna comprising:

stamping a metallic sheet to form an antenna plate having a plurality of antenna elements with a low frequency section and a high frequency section having a slot, the plurality of antenna elements being formed by the stamping process to punch the desired antenna shape from the metallic sheet; and folding the at least one antenna element about a portion of a perimeter of the stamped metallic sheet forming an upper surface, a side wall and a lower surface of the at least one antenna element.

2. The method of claim 1, wherein dimensions of the slot are formed in part by a parasitic arm formed within the high frequency section.

3. The method of claim 1, wherein an inductance loop is formed around at least a portion of the slot adjacent to the low frequency section.

4. The method of claim 1, wherein the upper frequency section has one or more resonant frequencies in the 5-6 GHz range and the lower frequency section has a resonant frequency in the 2-3 GHz range.

5. The method of claim 1, wherein a voltage across the slot provides radiation from the high frequency section when the wireless device is in operation.

6. The method of claim 1, further comprising the step of impressing a trench in a surface of the side wall of the at least one antenna element, such that the trench is perpendicular to a lower surface of the at least one antenna when folded.

7. The method of claim 6, further comprising the step of routing an antenna cable through the trench.

8. The method of claim 7, further comprising the step of electrically connecting the antenna cable to an upper surface of the high frequency section.

9. The method of claim 1, wherein the lower surface of the antenna element is a continuous common ground for the antenna plate.

10. The method of claim 1, wherein a shape of the antenna plate is substantially one of a ring and a polygon.

11. A dual band antenna formed by a process comprising steps of:

stamping a metallic sheet to form an antenna plate having a plurality of antenna elements with a low frequency section and a high frequency section having a slot, the plurality of antenna elements being formed by the stamping process to punch the desired antenna shape from the metallic sheet; and folding the at least one antenna element about a portion of a perimeter of the stamped metallic sheet forming an upper surface, a side wall and a lower surface of the at least one antenna element.

12. The dual band antenna of claim 11, wherein dimensions of the slot are formed in part by a parasitic arm formed within the high frequency section.

13. The dual band antenna of claim 11, wherein an inductance loop is formed around at least a portion of the slot adjacent to the low frequency section.

14. The dual band antenna of claim 11, wherein the upper frequency section has one or more resonant frequencies in the 5-6 GHz range and the lower frequency section has a resonant frequency in the 2-3 GHz range.

15. The dual band antenna of claim 11, wherein a voltage across the slot provides radiation from the high frequency section when the wireless device is in operation.

16. The dual band antenna of claim 11, further comprising the step of impressing a trench in a surface of the side wall of the at least one antenna element, such that the trench is perpendicular to a lower surface of the at least one antenna when folded.

17. The dual band antenna of claim 16, further comprising the step of routing an antenna cable through the trench.

18. The dual band antenna of claim 17, further comprising the step of electrically connecting the antenna cable to an upper surface of the high frequency section.

19. The dual band antenna of claim 11, wherein the lower surface of the antenna element is a continuous common ground for the antenna plate.

20. The dual band antenna of claim 11, wherein a shape of the antenna plate is substantially one of a ring and a polygon.

* * * * *